US010010755B2

(12) United States Patent
Watterson

(10) Patent No.: US 10,010,755 B2
(45) Date of Patent: Jul. 3, 2018

(54) CUSHIONING MECHANISM IN AN EXERCISE MACHINE

(71) Applicant: ICON Health & Fitness, Inc., Logan, UT (US)

(72) Inventor: Eric Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 197 days.

(21) Appl. No.: 14/997,075

(22) Filed: Jan. 15, 2016

(65) Prior Publication Data

US 2016/0206923 A1 Jul. 21, 2016

Related U.S. Application Data

(60) Provisional application No. 62/104,156, filed on Jan. 16, 2015.

(51) Int. Cl.

| | |
|---|---|
| ***A63B 24/00*** | (2006.01) |
| ***A63B 22/02*** | (2006.01) |
| ***A63B 21/005*** | (2006.01) |
| ***A63B 22/06*** | (2006.01) |
| ***A63B 22/20*** | (2006.01) |
| *A63B 22/00* | (2006.01) |
| *A63B 71/00* | (2006.01) |

(52) U.S. Cl.

CPC ..... *A63B 24/0087* (2013.01); *A63B 21/0051* (2013.01); *A63B 22/0023* (2013.01); *A63B 22/02* (2013.01); *A63B 22/0214* (2015.10); *A63B 22/0228* (2015.10); *A63B 22/0664* (2013.01); *A63B 22/203* (2013.01); *A63B 71/0054* (2013.01); *A63B 22/001* (2013.01); *A63B 22/0015* (2013.01); *A63B 22/0235* (2013.01); *A63B 22/0605* (2013.01); *A63B 2022/0676* (2013.01); *A63B 2071/0063* (2013.01); *A63B 2225/30* (2013.01)

(58) Field of Classification Search

CPC . A63B 22/02; A63B 22/0015; A63B 22/0023; A63B 22/0235; A63B 22/0664; A63B 22/0605; A63B 22/203; A63B 22/0214; A63B 22/0228; A63B 21/0051; A63B 2071/0063; A63B 71/0054; A63B 2022/0676; A63B 2225/30

See application file for complete search history.

(56) References Cited

U.S. PATENT DOCUMENTS

| | | | | |
|---|---|---|---|---|
| 9,114,276 | B2 * | 8/2015 | Bayerlein | A63B 21/0053 |
| 9,162,106 | B1 * | 10/2015 | Scheiman | A63B 23/08 |
| 9,827,458 | B2 * | 11/2017 | Dalton | A63B 21/055 |
| 2003/0148853 | A1 | 8/2003 | Alessandra et al. | |
| 2014/0265690 | A1 | 9/2014 | Henderson | |
| 2015/0352402 | A1 * | 12/2015 | Arnold | A63B 23/03591 482/57 |

* cited by examiner

*Primary Examiner* — Glenn Richman

(74) *Attorney, Agent, or Firm* — Ray Quinney & Nebeker

(57) ABSTRACT

An exercise machine includes a frame, a movable element movably attached to the frame that is movable in the performance of an exercise, and a magnetic assembly attached to the frame. The magnetic assembly has a magnetic unit movably positioned adjacent to a non-ferromagnetic material.

20 Claims, 7 Drawing Sheets

CUSHIONING MECHANISM IN AN EXERCISE MACHINE

RELATED APPLICATIONS

This application claims priority to U.S. Patent Application Ser. No. 62/104,156 titled "Cushioning Mechanism in an Exercise Machine" and filed on 16 Jan. 2015, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to have an aerobic workout indoors. One such type of an aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of exercise device is disclosed in U.S. Patent Publication No. 2003/0148853 issued to Nerio Alessandri, et al. In this reference, a physical exercise apparatus for recreational, rehabilitative, gymnastic, or sports purposes comprises at least one mobile part and at least one support part, interacting by means of field forces generated by magnetic fields inserted between relative parts of which the apparatus is made. Another type of device using magnetic fields is disclosed in U.S. Patent publication No. 2014/0265690 issued to Gregory D. Henderson. Both of these references are herein incorporated by reference for all that they contains.

SUMMARY

In one aspect of the invention, an exercise machine includes a frame.

In one aspect of the invention, the exercise machine includes a movable element movably attached to the frame that is movable in the performance of an exercise.

In one aspect of the invention, a magnetic assembly attached to the frame, the magnetic assembly comprising a magnetic unit movably positioned adjacent to a non-ferromagnetic material.

In one aspect of the invention, the magnetic unit moves with the movable element.

In one aspect of the invention, the magnetic unit is movably independent of the movable element.

In one aspect of the invention, the magnetic unit creates a secondary magnetic field in the non-ferromagnetic material as the magnetic unit moves such that the secondary magnetic field directs a repulsive force towards the magnetic unit.

In one aspect of the invention, the exercise machine further includes a seat assembly wherein the magnetic unit is integrated into the seat assembly.

In one aspect of the invention, the exercise machine further includes an exercise deck wherein the magnetic unit is integrated into the exercise deck.

In one aspect of the invention, the exercise machine further includes an exercise deck and an incline mechanism movably attached to the exercise deck and frame to incline the exercise deck wherein the magnetic unit is integrated into the exercise deck.

In one aspect of the invention, the exercise machine further includes a foot pedal assembly wherein the magnetic unit is integrated into the foot pedal assembly.

In one aspect of the invention, the exercise machine further includes a track attached to the frame and a linkage movably guided by the track.

In one aspect of the invention, the magnetic unit is integrated into the track.

In one aspect of the invention, the magnetic unit is integrated into the linkage.

In one aspect of the invention, the exercise machine further includes a crankshaft assembly wherein the magnetic unit is integrated into the crankshaft assembly.

In one aspect of the invention, the magnetic unit is movably disposed along a track.

In one aspect of the invention, the track is a linear track.

In one aspect of the invention, the track is a circular track.

In one aspect of the invention, the non-ferromagnetic material comprises an electrical conductor capable of generating a magnetic field that repels the magnetic unit as electrical current passes through the electrical conductor.

In one aspect of the invention, an exercise machine includes a frame.

In one aspect of the invention, the exercise machine includes a movable element movably attached to the frame that is movable in the performance of an exercise.

In one aspect of the invention, the exercise machine includes a magnetic assembly movably attached to the frame and movable with the movable element.

In one aspect of the invention, the magnetic assembly comprises a magnetic unit movably positioned adjacent to a non-ferromagnetic material.

In one aspect of the invention, the magnetic unit creates a secondary magnetic field in the non-ferromagnetic material as the magnetic unit moves such that the secondary magnetic field directs a repulsive force towards the magnetic unit.

In one aspect of the invention, the magnetic unit is movably disposed along a linear track.

In one aspect of the invention, wherein the magnetic unit is movably disposed along a circular track.

In one aspect of the invention, an exercise machine includes a frame.

In one aspect of the invention, the exercise machine includes a movable element movably attached to the frame that is movable in the performance of an exercise.

In one aspect of the invention, the exercise machine includes a magnetic assembly movably attached to the frame and movable with the movable element.

In one aspect of the invention, the magnetic assembly comprises a magnetic unit movably positioned adjacent to a non-ferromagnetic material.

In one aspect of the invention, the magnetic unit creates a secondary magnetic field in the non-ferromagnetic material as the magnetic unit moves such that the secondary magnetic field directs a repulsive force towards the magnetic unit.

In one aspect of the invention, the magnetic unit is movably disposed along a linear track.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
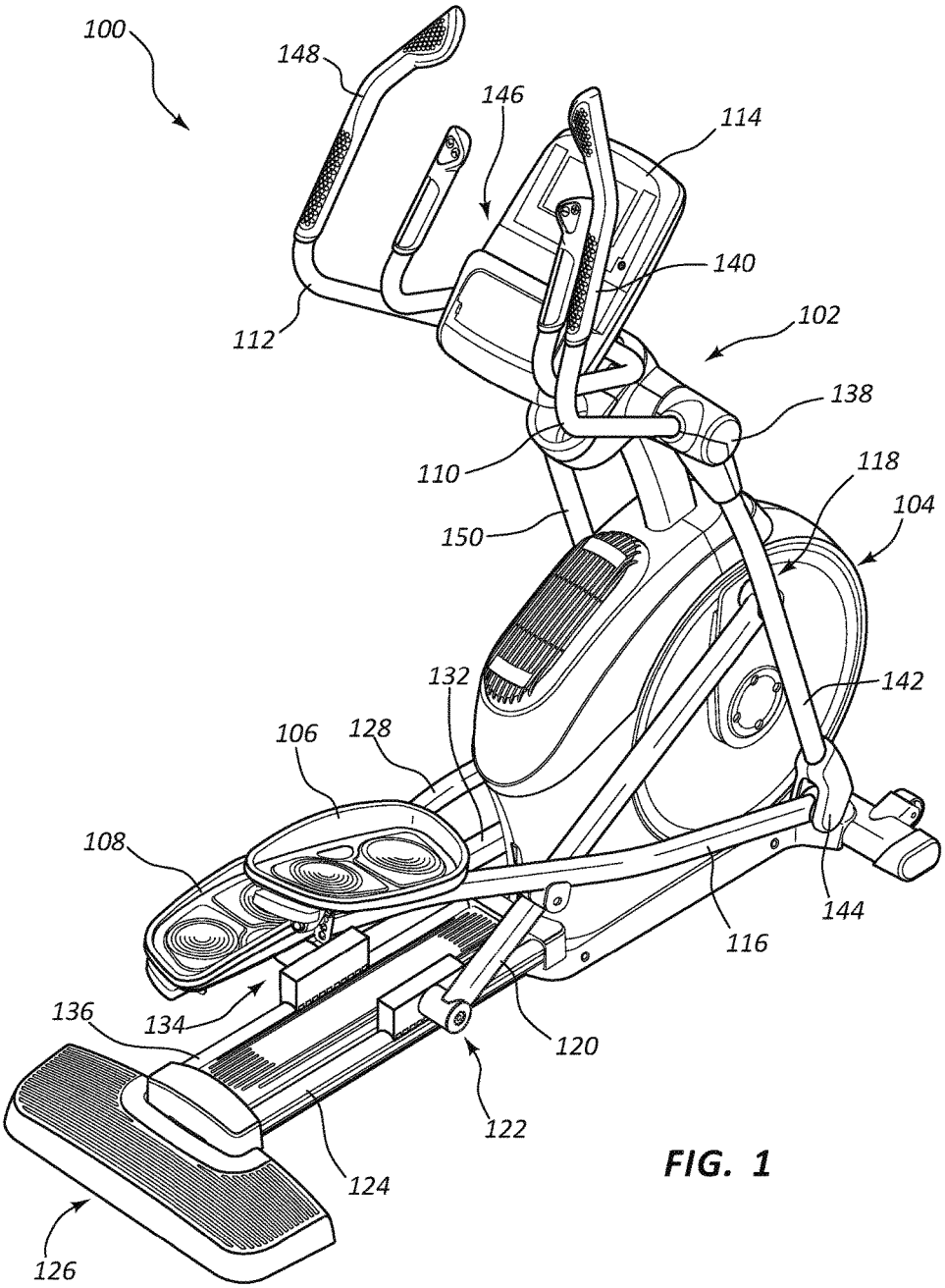
FIG. 1 illustrates a perspective view of an example of an exercise machine in accordance with the present disclosure.

Particularly, with reference to the figures, FIG. 1 depicts an example of an exercise machine 100, such as an elliptical machine. The exercise machine 100 includes a frame 102, a resistance mechanism 104, a right foot pedal 106, a left foot pedal 108, a right arm lever 110, a left arm lever 112, and a console 114. The right foot pedal 106 is linked to the right arm lever 110. Likewise, the left foot pedal 108 is linked to the left arm lever 112. Each of foot pedals 106, 108 and arm levers 110, 112 are arranged to move along reciprocating paths of each other. Further, each of foot pedals 106, 108 and arm levers 110, 112 are movably attached to the resistance mechanism 104 to resist the movement of the arm levers 110, 112 and the foot pedals 106, 108 along the reciprocating paths.

In the illustrated example, the right foot pedal 106 is attached to a right foot beam 116, which connects the right foot pedal 106 to the right arm lever 110. A right linkage 120 connects the right foot beam 116 to the resistance mechanism 104 at a right resistance end 118. The right linkage 120 also comprises a right track end 122 that is guided by a right track 124 of a base portion 126 of the frame 102.

Likewise, the left foot pedal 108 is attached to a left foot beam 128, which connects the left foot pedal 108 to the left arm lever 112. A left linkage 132 connects the connects the left foot beam 128 to the resistance mechanism 104. The left linkage 132 also comprises a left track end 134 that is guided by a left track 136 of the base portion 126 of the frame 102.

The right arm lever 110 is attached to the frame 102 at a right pivot connection 138. The right arm lever 110 comprises a right handle section 140 positioned above the right pivot connection 138 when the exercise machine 100 is oriented in an upright position. Further, the right arm lever 110 includes a right linkage section 142 that is positioned below the right pivot connection 138 when the exercise machine 100 is oriented in the upright position. The right linkage section 142 connects to the right foot beam 116 at a right joint 144. Thus, as the resistance mechanism 104 rotates, the right foot pedal 106 and right arm lever 110 move along the reciprocating paths.

Likewise, the left arm lever 112 is attached to the frame 102 at a left pivot connection 146. The left arm lever 112 comprises a left handle section 148 positioned above the left pivot connection 146 when the exercise machine 100 is oriented in an upright position. Further, the left arm lever 112 includes a left linkage section 150 that is positioned below the left pivot connection 146 when the exercise machine 100 is oriented in the upright position. The left linkage section 150 connects to the left foot beam 128 at a left joint. Thus, as the resistance mechanism 104 rotates, the left foot pedal 108 and left arm lever 112 move along the reciprocating paths.

The console 114 may contain a display and controls. The controls may allow the user to specify a resistance level to be applied by the resistance mechanism 104. In some examples, the controls may also be used to control other operating parameters of the exercise machine, such as incline, side to side tilt, speaker volume, programmed exercise routines, other parameters, or combinations thereof. The display may show selected parameters to the user. Further, the display may also be capable of presenting the user's physiological parameters, timers, clocks, scenery, routes, other types of information, or combinations thereof.

The right and left tracks 124, 136 guide the right and left track ends 122, 134, respectively. The right and left track ends 122, 134 support the weight of the user as the user stands on the foot pedals 106, 108. As the user moves his or her feet with the rotation of the resistance mechanism 104, the right track end 122 moves along the right track 124 and the left track end 134 moves along the left track 136. The connection between the right and left track ends 122, 134 with the right and left tracks 124, 136 is a non-contact connection when the right and left track ends 122, 134 are moving. In some examples, the movement between the track ends 122, 134 and the tracks 124, 136 creates a magnetic force that prevent the track ends 122, 134 and the tracks 124, 136 from making physical contact. However, in some cases, when the track ends 122, 134 and the tracks 124, 136 are static, there is not a sufficient magnetic force to prevent physical contact between the track ends 122, 134 and the tracks 124, 136. The interaction between the tracks 124, 136 and the track ends 122, 134 will be described in more detail in conjunction with FIGS. 2 and 3*a*.

Figure 2A:
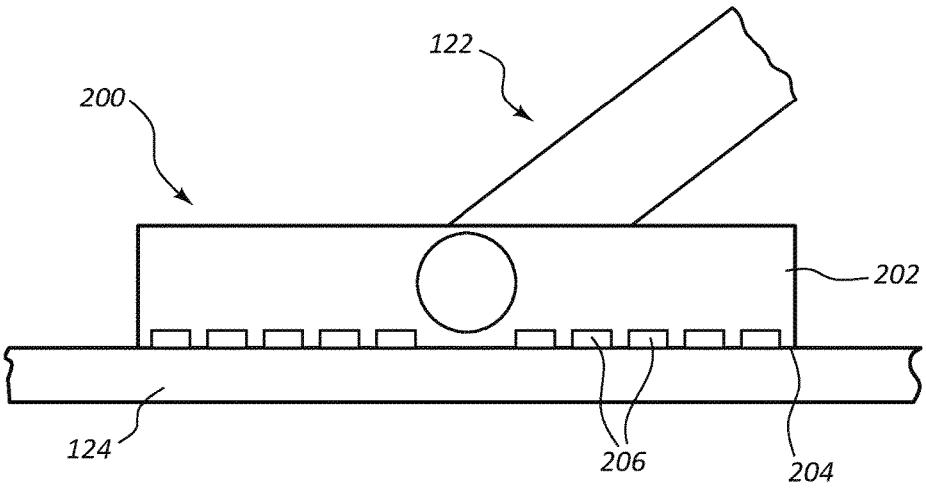
FIG. 2A illustrates a side view of an example of a magnetic assembly integrated into the exercise machine in accordance with the present disclosure.
Figure 2B:
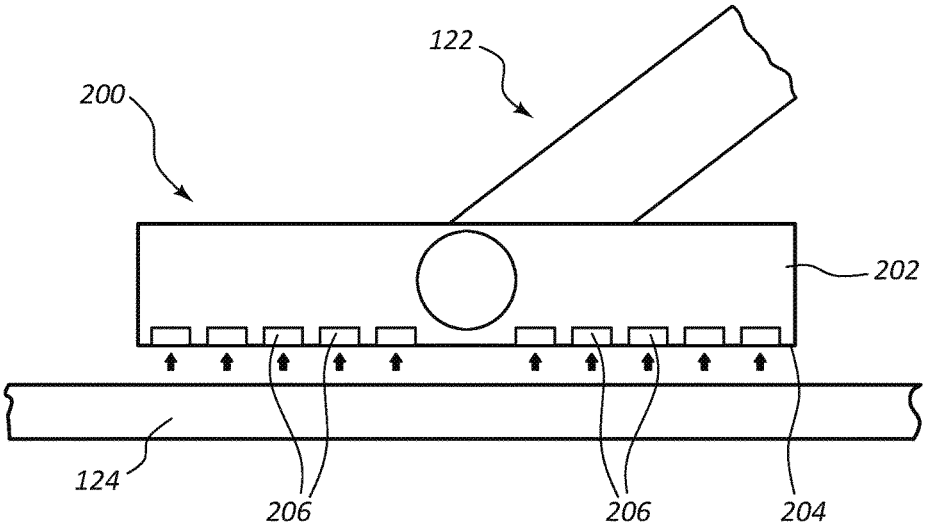
FIG. 2B illustrates a side view of an example of a magnetic assembly integrated into the exercise machine in accordance with the present disclosure.

FIGS. 2A and 2B depicts an example magnetic assembly integrated into the exercise machine 100 at the right track 124 and the right track end 122 of the right linkage 120. Such an example may be integrated into the exercise machine of FIG. 1, but in other embodiments, the examples in FIGS. 2A and 2B can be integrated into other types models and types of exercise machines 100. In the illustrated example, there is no movement between the right track 124 and the right track end 122. The magnetic unit 200 is pivotally attached to the right track end 122. The magnetic unit 200 comprises a housing 202 with an underside 204 facing the track 124. In this example, multiple magnets 206 are embedded in the underside 204 such that the magnets 206 collectively create a magnetic field that is directed towards the track 124.

In some examples, each of the magnets individually direct a magnetic field towards the track. In other examples, at least some of the magnets are oriented to direct their individual magnetic fields in ways that augment the collective magnetic field. For example, the magnets may be arranged to achieve a Halbach effect. In such an arrangement, a first magnet may be positioned to direct its magnetic field towards the track, and magnets positioned adjacent on either side of the first magnet may be oriented to direct their magnetic fields towards the first magnet. Such an arrangement may exhibit a collective magnetic field that projects farther into the track than if each of the magnets individually directed their magnetic fields towards the track.

Further, in the illustrated example, the track 124 is made of a non-ferromagnetic material. A non-exhaustive list of non-ferromagnetic materials may include aluminum, copper, silver, lead, magnesium, platinum, tungsten, alloys of otherwise magnetic materials, mixtures thereof, alloys thereof, composites thereof, other materials, or combinations thereof. In some cases, the non-ferromagnetic material produces no magnetic field or just a weak magnetic field. However, the non-ferromagnetic material may be electrically conductive such that when the non-ferromagnetic material is exposed to a magnetic field, an electrical current is generated in the non-ferromagnetic material. Such electrical current may cause a secondary magnetic field to be generated. Such a secondary magnetic field may oppose individual or collective magnetic fields generated by the magnets 206 in the magnetic units 200. Thus, the secondary magnetic field may apply a magnetic force that repels the magnetic unit 200. The characteristics of such a magnetic force from the non-ferromagnetic material may be dependent on the volume of non-ferromagnetic material, the electrical conductivity of the non-ferromagnetic material, the strength of the magnetic field from the magnets 206 in the magnetic unit 200, the spacing of the magnets 206 in the housing's underside 204, the orientation of the magnets 206 in the housing's underside 204, the speed of the relative movement between the track 124 and the track end 122, other factors, or combinations thereof.

In some examples, the characteristics of the magnetic unit 200 and the track 124 are such that the secondary magnetic field is strong enough to repel the magnetic unit 200 such that the track end 122 is levitated off of the track 124 when the track end 122 is moving along the track 124. An example of the track end 122 being levitated off of the track 124 is depicted in FIG. 2B. In those circumstances where the track end 122 is levitated off of the track 124, minimal physical friction between the track 124 and the track end 122 may exist. Such minimal friction reduces wear and tear from movement between the track 124 and the track end 122. Further, the magnetic fields from the magnetic unit 200 and the non-ferromagnetic material may absorb variations in the forces applied to the non-contact connection based on the movements of the user. For example, in circumstances where the user pushes harder at times against the foot pedal, the additional stresses generated by such a harder push may be exhibited by a narrowing of a gap between the track 124 and the levitating track end 122. Thus, the additional shocks and jots generated from a user's exercises may impose minimal mechanical strain on at least some of the components of the exercise machine 100. Thus, the secondary magnetic field may exhibit at least some of the characteristics of a shock absorber.

While the examples depicted in FIGS. 2A and 2B are illustrated with a flat track 124, in other examples the track 124 may have a side wall that assists in guiding the track end 122. In such examples, the gap formed by the levitation of the track end 122 may or may not exceed the height of the side wall. In yet other examples, the track 124 may include an ceiling overhang that prevents the magnetic unit 200 from levitating higher than desired. In such circumstances, the magnets 206 may be positioned on the top side of the housing 202 to create another secondary magnetic field in the ceiling overhang to prevent physical contact between the ceiling overhang and the magnetic unit 200. In additional examples, at least some magnets 206 may be disposed in a side of the magnetic unit's housing 202, which may prevent physical contact between the magnetic unit 200 and a side wall of the track 124.

Figure 3:
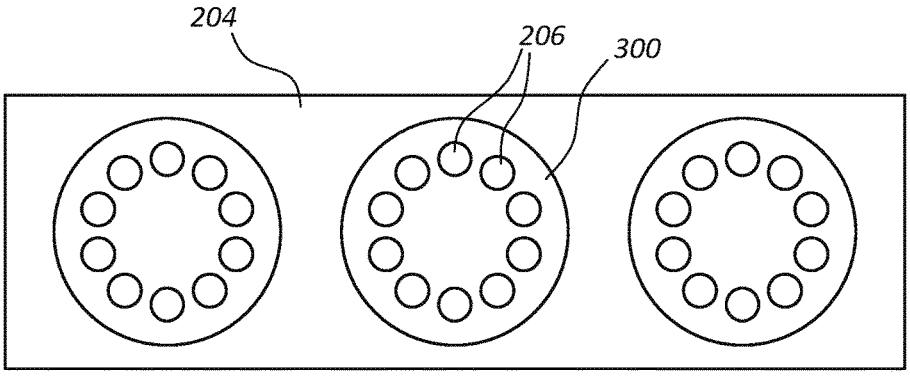
FIG. 3 illustrates a bottom view of an example of an underside of a magnetic unit integrated into the exercise machine in accordance with the present disclosure.

FIG. 3 depicts an alternative example of the housing's underside 204. In this illustrated example, each of the magnets 206 are embedded in a magnetic unit that includes a rotor 300 that can be driven by a motor. In this example, the motor can cause the rotor 300 to rotate and move the magnets 206 independently of the track end 122. As a result, the motor may be driven to cause the track end 122 to levitate without movement of the track end 122 caused from the user imparting forces on the foot pedals 106. In some examples, the motor may be able to cause faster relative movement between the magnets 206 and the non-ferromagnetic material thereby causing a greater secondary magnetic field, which may create a greater levitation force. In some examples, the speed of the rotors 300 can be adjusted to achieve a desired levitation height. Such speed variations may account for the speed at which the user causes the right and left track ends to move along the right and left tracks.

In some situations, the motor drives the rotation of the rotors 300 when power is supplied to the exercise machine 100. In other examples, the motor is caused to rotate the rotors 300 when instructed by the user. In yet other examples, the rotors 300 are driven in response to detected movement of the foot pedals 106, 108, movement of the arm levers 110, 112, movement of another component of the exercise machine 100, or combinations thereof.

Figure 4:
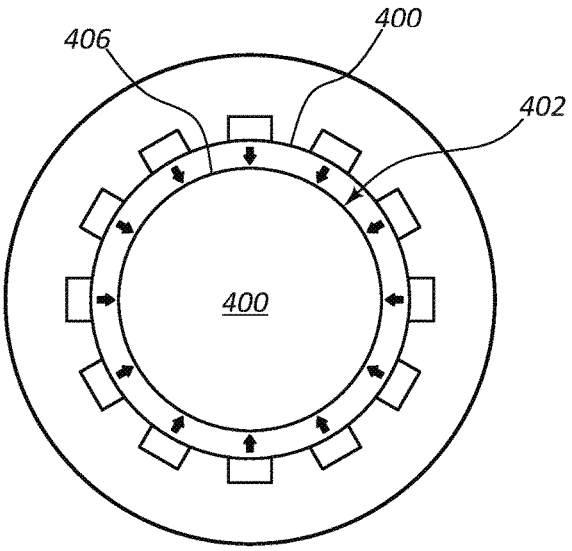
FIG. 4 illustrates a side view of an example of a magnetic assembly integrated into the exercise machine in accordance with the present disclosure.

The principles described herein about causing magnetically induced levitation between parts of the exercise machine 100 can be applied to other locations on the exercise machine 100 than just the junction between the track ends 122, 134 of the linkages 120, 132 and the tracks 124, 136. For example, these principles may be applied to the right and left resistance ends 118, 130 of the right and left linkages 120, 132. In the example of FIG. 4, an axle 400 protruding from the resistance mechanism 104 is depicted as being inserted between an aperture 402 of the resistance end of one of the right or left linkages 120, 132. In this example, the inside perimeter 404 of the aperture 402 is greater than the outside perimeter 406 of the axle 400 such that a gap exists there between. In this example, magnets 206 are disposed along the inside perimeter 404 of the aperture 402. Also, the axle 400 may be made of a non-ferromagnetic material that exhibits the ability to create a secondary magnetic field in response to exposure of a moving magnetic field as described above. In such examples, when relative movement is caused between the aperture 402 and the axle 400, magnetic fields from the magnets 206 in the inside perimeter 404 of the aperture 402 move through the non-ferromagnetic material of the axle 400 resulting in inducing a secondary magnetic field. In such an example, the secondary magnetic field may repel the magnets 206 in the inside perimeter 404 causing the axle 400 to center within the aperture 402 such that an annular gap between the axle 400 and the inside perimeter 404 is formed. Such an arrangement may reduce the wear and tear conventionally associated with the connections between linkages and the resistance mechanism.

Figure 5A:
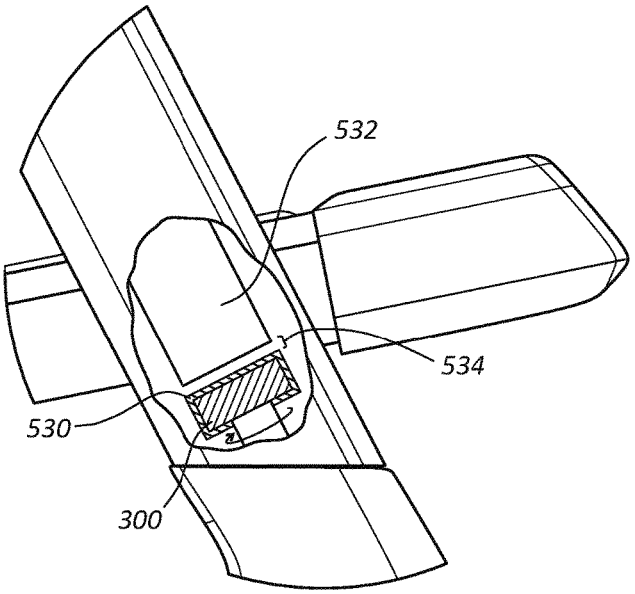
FIG. 5A illustrates a side view of an example of an incline mechanism in a treadmill in accordance with the present disclosure.
Figure 5B:
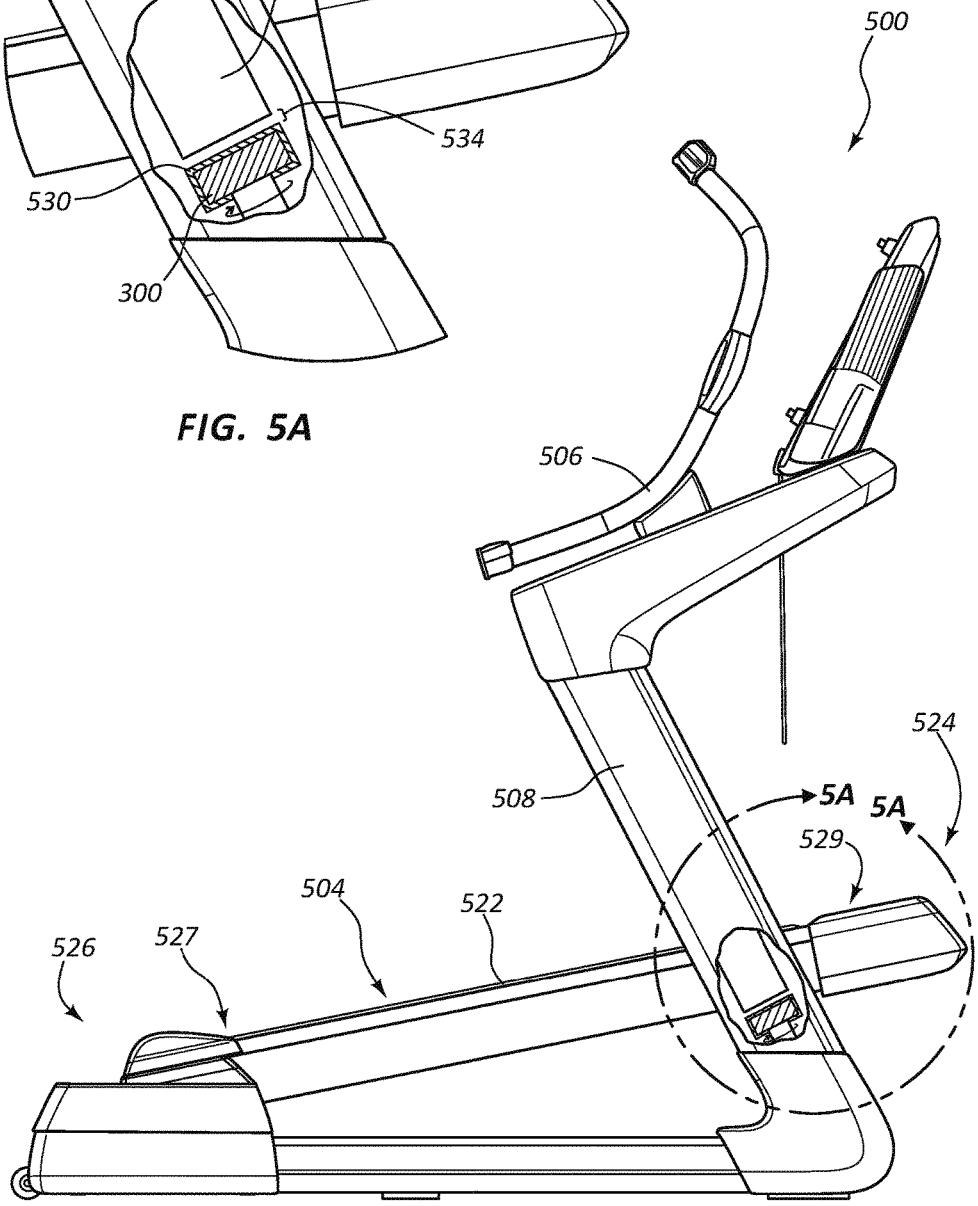
FIG. 5B illustrates a side view of an example of an incline mechanism in a treadmill in accordance with the present disclosure.

FIGS. 5A and 5B illustrate an example of another type of exercise machine, such as a treadmill 500 in accordance with the present disclosure. In this example, the treadmill 500 includes a frame 502, an exercise deck 504, and a pair of arm rests 506.

In this example, the frame 502 has a pair of frame posts 508 connected to the exercise deck 504. The exercise deck 504 includes a tread belt 522 that spans between a front pulley at a front end 524 of the treadmill 500 and a rear pulley at a rear end 526 of the treadmill 500. In some examples, one of the front pulley or the rear pulley is driven by a motor, which causes the tread belt 522 to rotate about the front and rear pulleys. In some examples, a top surface of the tread belt 522 moves from the front pulley to the rear pulley.

An incline mechanism may be used to control the front to rear slope of the exercise deck 504. Any appropriate type of incline mechanism may be used to raise and/or lower either a front section 527 or a rear section 529 of the exercise deck 504. Further, any appropriate type of slope may be achieved with the incline mechanism. In some examples, the front to rear slope of the exercise deck 504 may be oriented at a negative angle where the front section 527 is lower than the rear section 529. In other examples, the front to rear slope angle is between negative 45.0 degrees and positive 45.0 degrees. Further, in some embodiments, the exercise deck 504 is capable of changing its side to side tilt angle.

The incline mechanism may comprise a rotor 300 similar to the rotor depicted in FIG. 4 where magnets 206 are disposed on the face 530 of the rotor 300. In the illustrated example, the rotor 300 is positioned adjacent to a section 532 of the posts 508 that comprises a non-ferromagnetic material. In the illustrated example, the rotor 300 may be moved along the length of the posts 508 to control the front to rear incline of the exercise deck 504. Further, the rotor 300 may be rotated at any position along the length of the posts 508. As the rotor 300 rotates, the magnet's magnetic fields move through the non-ferromagnetic material of the post's section 532 causing the secondary magnetic field to be generated. As a result, the non-ferromagnetic section 532 is levitated away from the rotor 300 which lifts the entire post 508 thereby increasing the incline slope of the exercise deck 504. A gap 534 may be formed between the rotor 300 and the non-ferromagnetic section 532. As the user runs on the exercise deck 504, an additional load may be placed on the exercise deck 504 each time the user's feet impact the exercise deck 504. The magnetic forces causing the non-ferromagnetic section 532 to levitate may exhibit at least some of the characteristics of a shock absorber. However, wear and tear is reduced because there is no physical contact between the non-ferromagnetic section 532 and the rotor 300.

Figure 6:
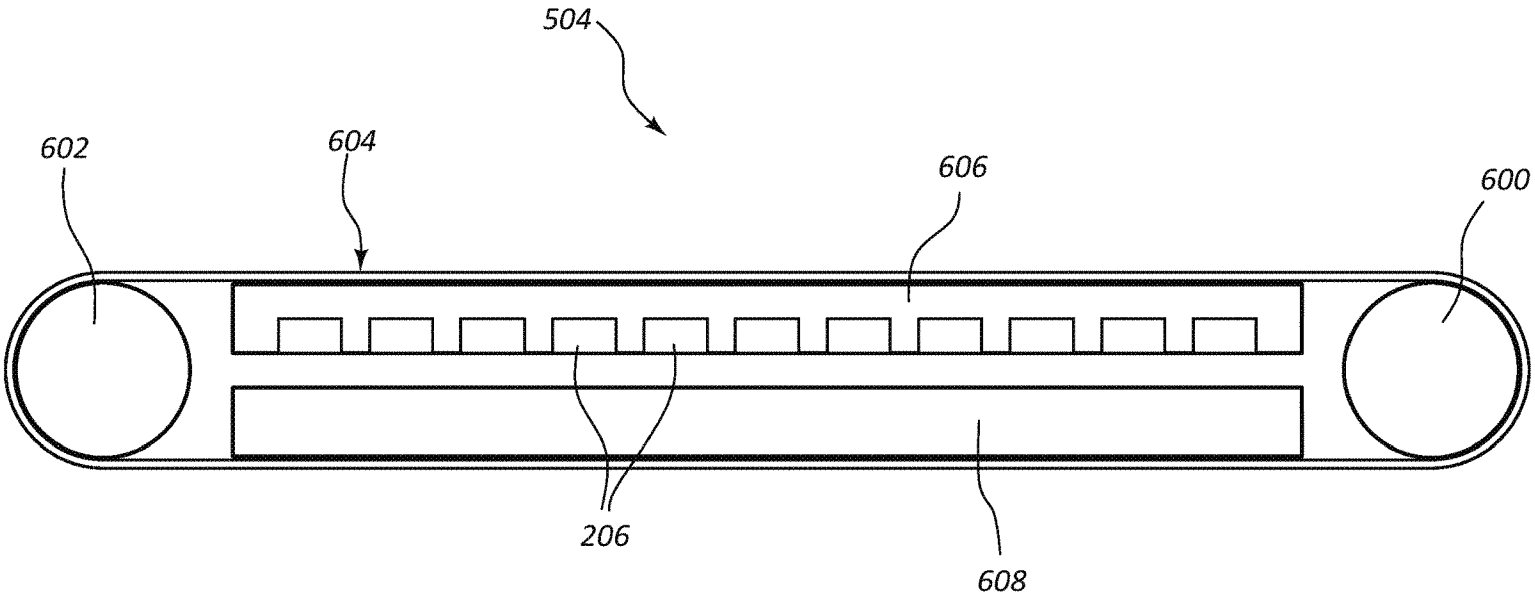
FIG. 6 illustrates a side view of an example of a treadmill deck in accordance with the present disclosure.

FIG. 6 depicts an example of an exercise deck 504 of a treadmill 500. In this example, a front pulley of the tread belt 522 is disposed around a first pulley 600 and a second pulley 602. A platform 604 is disposed between the first and second pulleys 600, 602. In the example of FIG. 6, the platform 604 includes a first portion 606 that is disposed over a second portion 608. The first portion 606 comprises magnets 206 that are capable of moving, such as with a motor, a linear actuator, or another type of actuator. The second portion may comprise a non-ferromagnetic material that is positioned to be exposed to the moving magnetic fields of the magnets 206 as the magnets 206 move relative to the non-ferromagnetic material. As described above, such moving magnetic fields may result in a secondary magnetic field that repels the magnets 206. As a result, the first portion 606 of the platform 604 may levitate over the second portion 608. In such circumstances, when a user exercises on the exercise deck 504, the user's feet may have a varying load on the first portion 606 of the platform 604 as the user's feet impact the tread belt 522 at different times. The variations in loads may be absorbed by magnetic fields that cause a gap to form between the first and second portions 606, 608 of the platform 604. Thus, such an exercise deck 504 as described in conjunction with FIG. 6 may exhibit characteristics of a shock absorber between the first and second portions 606, 608 of the platform 604.

Figure 7:
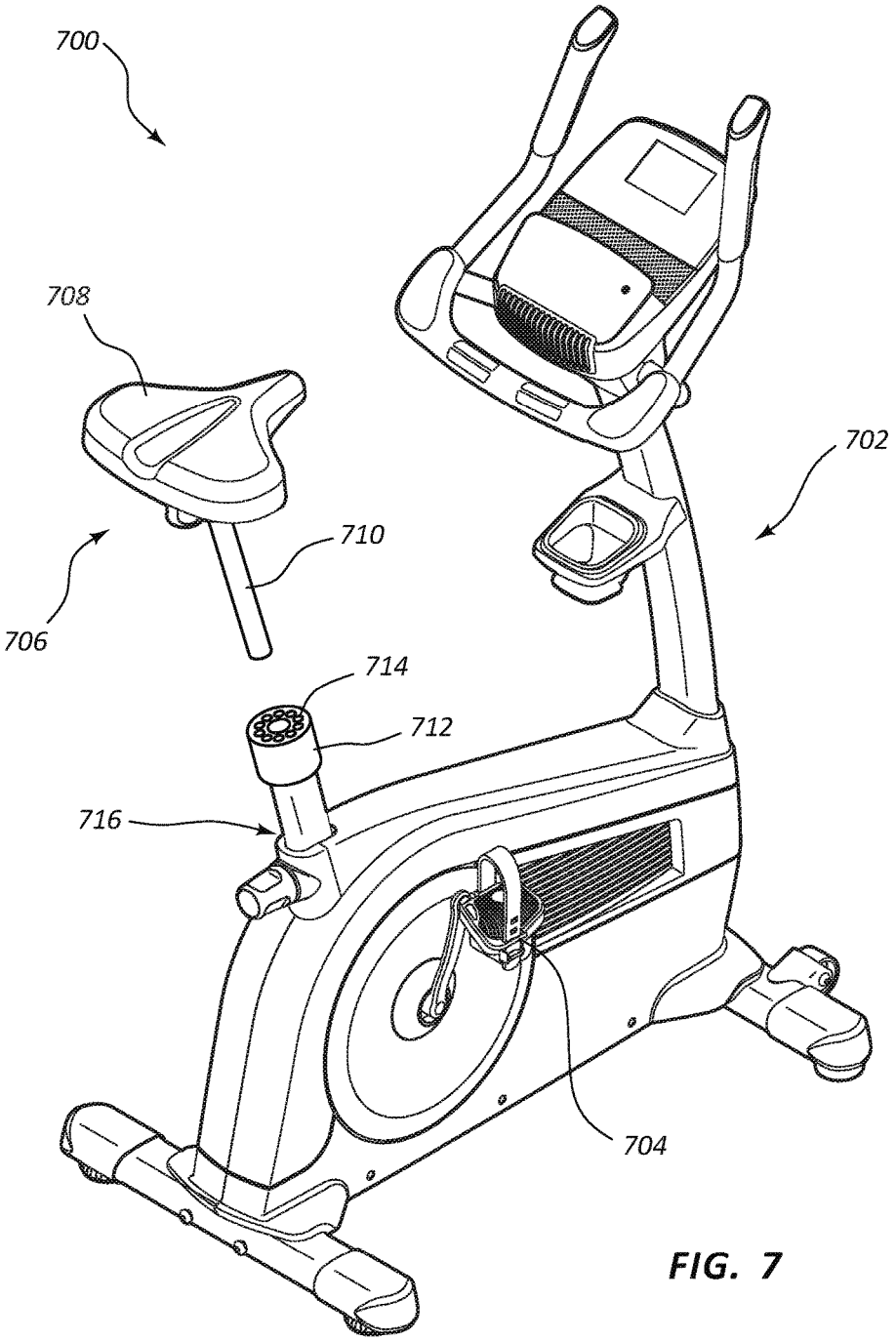
FIG. 7 illustrates an exploded view of an example of a seat of a stationary bike in accordance with the present disclosure.

FIG. 7 depicts an exploded view of a stationary bike 700. In this example, the stationary bike comprises a frame 702, an internal resistance mechanism, foot pedals 704, and a seat assembly 706. The seat assembly 706 includes a saddle 708, a seat post 710, a rotor 712 containing multiple magnets 206 embedded in the rotor's face 714, and a seat opening 716. An underside of the saddle 780 is connected to the seat post 710 which is received within the seat opening 716. The rotor 712 is disposed within the seat opening 716 such that the rotor's face 714 is adjacent to the seat post 710. The seat post 710 may comprise a non-ferromagnetic material that is positioned to be exposed to the moving magnetic fields from the rotor's face 714 as the rotor 712 rotates. In such circumstances, the seat post 710 may be subjected to a force that pushes the seat post 710 upward within the seat opening 716. As a user sits on the saddle 708, the user may vary the amount of load he or she places on the saddle 708. Magnetic forces pushing against the load applied by the user may exhibit at least some of the characteristics of a shock absorber within in the seat assembly 706.

In some examples of a seat assembly 706, a motor or another type of actuator which causes the rotor 712 to rotate is activated in response to detecting that a user is sitting on the saddle 708. In other examples, the motor is activated in response to detecting that the foot pedals 704 are being moved. In yet another example, the motor is activated in response to commands inputted into the exercise machine 100 by the user. While the seat assembly 706 has been described with specific mechanisms for triggering the rotor 712 to rotate, any appropriate mechanism for triggering the rotation of the rotor 712 may be used in accordance with the principles described in the present disclosure.

Figure 8:
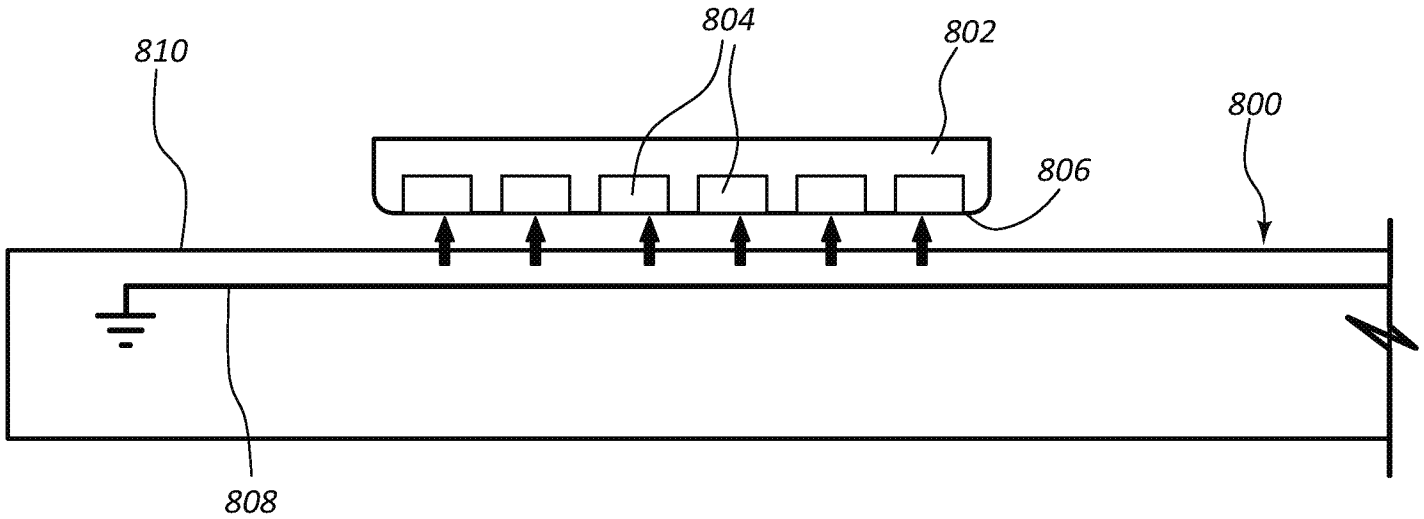
FIG. 8 illustrates a side view of an example of a track in an exercise machine in accordance with the present disclosure.

FIG. 8 depicts a track 800 and a foot pedal 802. In this illustrated example, magnets 804 are disposed on the underside 806 of the foot pedal such that the magnets 804 direct a magnetic field towards the track 800. Such a track 800 and foot pedal 802 may be part of an exercise machine 100 constructed to simulate a cross country skiing motion. As such, the foot pedal 802 may be arranged to slide along a length of the track 800.

The track 800 may be made of a non-ferromagnetic material such that a secondary magnetic field is generated as the foot pedal 802 moves along the track 800. In this illustrated example, the track 800 also includes an electrical conductor 808 that is embedded into the track and is adjacent to the track's surface 810. Such an electrical conductor 808 may be electrically grounded to the track 800 or another appropriate component of the exercise machine 100. The electrical conductor 808 may be arranged to carry an alternating current from any appropriate source. In one example, the exercise machine can be plugged into the alternating electrical current source used by the home or building in which the exercise machine 100 resides. As the alternating current changes polarity, the electrical and magnetic characteristics of the electrical conductor may generate a secondary magnetic field that exhibits the characteristics of magnetically repelling the magnets 804 in the foot pedal 802. Thus, the foot pedal 802 may be caused to levitate in response to causing the electrical conductor 808 to carry the alternating current.

In some examples of such a track 800 and foot pedal 802 arrangement, the electrical conductor 808 may be caused to carry the alternating current in response to sensing the user's weight on the foot pedal 802. In other examples, the electrical conductor 808 is caused to carry the alternating current in response to detecting relative movement between the foot pedal 802 and the track 800. In yet another example, the electrical conductor 808 is caused to carry the alternating current in response to commands inputted into the exercise machine 100 by the user. While the arrangement depicted in FIG. 8 has been described with specific mechanisms for causing the electrical conductor 808 to carry alternating current, any appropriate mechanism for causing the electrical conductor 808 to carry alternating current may be used in accordance with the principles described in the present disclosure.

While the examples above have described magnetic assemblies with two portions where the first portions contains permanent magnets and the second portion contains a non-ferromagnetic material, in other examples, the magnets are embedded in the second portion and the non-ferromagnetic material is integrated into the first portion. Also, the examples above have been described with either the first portion or the second portion having a non-ferromagnetic portion. In some cases, the entire structure of the portions are made of the non-ferromagnetic material. In other examples, the coating of non-ferromagnetic material is applied to the appropriate structures of the first and second portions.

While the examples above have described the arrangement of the magnets and the non-ferromagnetic material being used to absorb shocks, reduce wear, separate components of the exercise machine, the arrangement may be used for any appropriate functions. The arrangement may be incorporated into incline mechanisms, side to side tilt mechanisms, shock absorbers, skier tracks, other types of tracks, seat assemblies, crankshaft assemblies, foot pedal assemblies, pulley mechanisms, arm lever mechanisms, other types of assemblies of an exercise machine, mechanical linkages, or combinations thereof.

The relative movement between the magnets 206 and the non-ferromagnetic material may be at any appropriate speed. In some examples, the speeds that cause the desired levitation effect are over 0.5 miles per hour. In examples where the magnets 206 are disposed on rotors 300, the rotors 300 may be caused to spin between 1.0 to 500.0 revolutions per minute.

Additionally, any appropriate type of magnet may be used to create the desired levitation effect. For example, the magnets may be permanent magnets. In other examples, the magnets are electromagnets. A non-exhaustive list of the materials of the magnets may include iron, ferrite, nickel, cobalt, rare earth metals, lodestone, other minerals, other elements, alloys thereof, mixtures thereof, composites thereof, or combinations thereof.

INDUSTRIAL APPLICABILITY

In general, the invention disclosed herein may provide the user with an exercise machine that experiences minimal amounts of wear and tear for at least some of the components of the exercise machine. The reduced or eliminated wear and tear may be accomplished by incorporating magnets into a first component of the exercise machine and incorporating a non-ferromagnetic material into a second, adjacent component of the exercise machine where the second component is arranged to move relative to the first component. The characteristics of magnetic fields from the magnets and the non-ferromagnetic material may cause the generation of a secondary magnetic field in the non-ferromagnetic material. The secondary magnetic field may oppose the primary magnetic field from the magnets creating opposing magnetic forces that repel one another. Such opposing magnetic forces may cause one of the components to levitate over the other component. In other examples, the opposing magnetic forces may prevent the components from contacting one another.

The non-contact intersections between the first and second components may aid in allowing the components to move in relation to each other without making physical contact. Without physical contact, the components may experience a reduced amount of wear at the intersection of the two components. In some cases, the wear between the two components may be completely eliminated. Conventional exercise machines may be constructed such that joints that are prone to wear are reinforced with specialized materials to form bearing surfaces to reduce wear. In some circumstances, owners of such exercise machines with such prone joints may be instructed to maintain the exercise machine by periodically greasing the joints. With the principles described in the present disclosure, the prone wear joints of exercise machines may be made with a non-ferromagnetic material and magnets to prevent and/or eliminate the wear. Thus, the owners may not need to grease such joints or perform other types of maintenance tasks to such joints.

The relative movement between the non-ferromagnetic material and the magnets may be induced when the user causes the movable element of the exercise machine to move. For example, the user may cause the foot pedals of an elliptical exercise machine to move and either the non-ferromagnetic material or the magnets may move with the foot pedal. Such movement may cause the non-ferromagnetic material and the magnets to move relative to each other, but still within a proximity of one another that the magnetic fields of the magnets pass through the non-ferromagnetic material. Thus, the separation of the components may be inherently caused from the movement induced manually by the user.

In other examples, the relative movement between the non-ferromagnetic material and the magnets occurs independently of the movement manually induced by the user. In such examples, the magnets may be incorporated into a rotor or a linear actuator that causes the magnets to move relative to the non-ferromagnetic material. Thus, the separation and/or levitation of the components may occur prior to the user manually moving a movable element of the exercise machine. In other examples, the exercise machine may detect when the user is in the process of using the exercise machine or is about to use the exercise machine. In such examples, the exercise machine may cause the rotor or linear actuator to move to create the desired separation and/or levitation effect.

In examples where the magnets are incorporated into a rotor, the rotor may move the magnets along a circular track defined by the motion of the rotor. In examples where the magnets are incorporated into a linear actuator, the magnets may be moved along a linear track defined by the movement of the linear actuator. Likewise, in those examples where the magnets follow a track incorporated into the exercise machine, such as those tracks described in relation to FIGS. 1-3, 5, 7, and 8, the resulting secondary magnetic field may cause the other magnets to move in a linear direction, a curved direction, or another type of direction which are defined by the shape of the tracks.

In other examples, the levitation effect may occur based on the changing polarity of an electric alternating current in the non-ferromagnetic material. For example, an alternating electrical current may be carried by an electrical conductor embedded into the non-ferromagnetic material. As the polarity of the electrical current switches, the effects of creating a secondary magnetic field may be exhibited in the non-ferromagnetic material. Such a secondary magnetic field may cause the magnets to move away from the non-ferromagnetic material thereby forming a gap between the component with the magnets and the component with the non-ferromagnetic material.

What is claimed is:

1. An exercise machine, comprising:

a frame;

a movable element movably attached to the frame that is configured to move with respect to the frame during a user's performance of an exercise and that is configured to support a weight of the user during the user's performance of the exercise; and a magnetic assembly attached to the frame, the magnetic assembly comprising:

a non-ferromagnetic material; and a magnetic unit movably positioned adjacent to the non-ferromagnetic material, the magnetic unit configured to create a secondary magnetic field in the non-ferromagnetic material as the magnetic unit moves with respect to the non-ferromagnetic material such that the secondary magnetic field directs a repulsive force toward the magnetic unit.

2. The exercise machine of claim 1, wherein the magnetic unit or the non-ferromagnetic material is configured to move with the movable element.

3. The exercise machine of claim 1, wherein the magnetic unit or the non-ferromagnetic material is configured to move independent of the movable element.

4. The exercise machine of claim 2, further comprising a seat assembly wherein the magnetic unit is integrated into the seat assembly.

5. The exercise machine of claim 2, further comprising an exercise deck wherein the magnetic unit is integrated into the exercise deck.

6. The exercise machine of claim 2, further comprising:

an exercise deck; and an incline mechanism movably attached to the exercise deck and the frame and configured to selectively incline the exercise deck;

wherein the magnetic unit is integrated into the exercise deck.

7. The exercise machine of claim 2, further comprising a foot pedal assembly wherein the magnetic unit is integrated into the foot pedal assembly.

8. The exercise machine of claim 2, further comprising:

a track attached to the frame, and a linkage movably guided by the track.

9. The exercise machine of claim 8, wherein the magnetic unit is integrated into the track.

10. The exercise machine of claim 8, wherein the magnetic unit is integrated into the linkage.

11. The exercise machine of claim 2, further comprising a crankshaft assembly, wherein the magnetic unit is integrated into the crankshaft assembly.

12. The exercise machine of claim 2, wherein the magnetic unit is movably disposed along a track.

13. The exercise machine of claim 12, wherein the track is a linear track.

14. The exercise machine of claim 12, wherein the track is a circular track.

15. The exercise machine of claim 2, wherein the non-ferromagnetic material comprises an electrical conductor that is configured to generate a magnetic field that repels the magnetic unit as current passes through the electrical conductor.

16. An exercise machine, comprising:

a frame;

a movable element movably attached to the frame that is configured to move with respect to the frame during a user's performance of an exercise and that is configured to support a weight of the user during the user's performance of the exercise; and a magnetic assembly movably attached to the frame and at least a portion of which is configured to move with the movable element, the magnetic assembly comprising:

a non-ferromagnetic material; and a magnetic unit movably positioned adjacent to a non-ferromagnetic material, the magnetic unit configured to create a secondary magnetic field in the non-ferromagnetic material as the magnetic unit moves with respect to the non-ferromagnetic material such that the secondary magnetic field directs a repulsive force towards the magnetic unit, the magnetic unit movably disposed along a linear track.

17. The exercise machine of claim 16, wherein:

the movable element includes a track end;

the magnetic unit is integrated into the track end;

the exercise machine further comprises a foot pedal supported by the track end;

the non-ferromagnetic material is integrated into the linear track; and the secondary magnetic field is configured to prevent the track end from making physical contact with the linear track as the user moves the foot pedal during at least a portion of the user's performance of the exercise.

18. The exercise machine of claim 16, wherein:

the movable element includes a track end;

the non-ferromagnetic material is integrated into the track end;

the exercise machine further comprises a foot pedal supported by the track end;

the magnetic unit is integrated into the linear track; and the secondary magnetic field is configured to prevent the track end from making physical contact with the linear track as the user moves the foot pedal during at least a portion of the user's performance of the exercise.

19. The exercise machine of claim 16, wherein:

the movable element includes a foot pedal;

the magnetic unit is integrated into foot pedal;

the non-ferromagnetic material is integrated into the linear track; and the secondary magnetic field is configured to prevent the foot pedal from making physical contact with the linear track as the user moves the foot pedal during at least a portion of the user's performance of the exercise.

20. The exercise machine of claim 16, wherein:

the movable element includes a foot pedal;

the non-ferromagnetic material is integrated into the foot pedal;

the magnetic unit is integrated into the linear track; and the secondary magnetic field is configured to prevent the foot pedal from making physical contact with the linear track as the user moves the foot pedal during at least a portion of the user's performance of the exercise.

* * * * *